US005662521A

United States Patent [19]

Latz et al.

[11] Patent Number: 5,662,521

[45] Date of Patent: Sep. 2, 1997

[54] SAFETY WORK BENCH WITH ARM REST

[75] Inventors: Christopher Latz, Hanau; Walter Glück, Hasselroth, both of Germany

[73] Assignee: Heraeus Instruments GmbH, Hanau, Germany

[21] Appl. No.: 625,476

[22] Filed: Mar. 29, 1996

[30] Foreign Application Priority Data

Apr. 6, 1995 [DE] Germany ..... 195 12 889.3

[51] Int. Cl.[6] ..... B08B 15/02

[52] U.S. Cl. ..... 454/57; 248/118; 454/56

[58] Field of Search ..... 454/56, 57, 60; 248/118; 247/411.23, 411.26

[56] References Cited

U.S. PATENT DOCUMENTS

| | | | |
|---|---|---|---|
| 3,425,335 | 2/1969 | Black | 454/57 |
| 4,179,984 | 12/1979 | Gorcey . | |
| 5,288,042 | 2/1994 | Grimm | 248/118 |
| 5,385,322 | 1/1995 | Kim et al. | 248/118 |

FOREIGN PATENT DOCUMENTS 2 112 927 7/1983 United Kingdom .

OTHER PUBLICATIONS

Heraeus Instruments, *Bilogische Sicherheitswerkbänke Heraeus LaminAir® HB and HBB,* Feb. 1992, 6 page brochure.

*Primary Examiner*—Harold Joyce

*Attorney, Agent, or Firm*—Panitch Schwarze Jacobs & Nadel, P.C.

[57] ABSTRACT

A safety work bench with a work opening, whose lower boundary is formed by a boundary plate in which ventilation openings are arranged for the generation of a vertical air current, has at least one arm rest installed in the lower area of the work opening. In order to create a safety work bench in which the arm rests are easy to decontaminate, and in order not to significantly diminish the effective cross section of the ventilation openings, the arm rests are constructed as a separate structural member and are detachably mounted on the boundary plate at a distance from it.

7 Claims, 2 Drawing Sheets

SAFETY WORK BENCH WITH ARM REST

FIELD OF THE INVENTION

The invention concerns a safety work bench with a work opening, whose lower boundary is formed by a boundary plate in which ventilation openings are arranged for generating a vertical air current, and with at least one arm rest mounted in the lower area of the work opening.

BACKGROUND OF THE INVENTION

Safety work benches of this type are generally known, for example from the company brochure "Biological Safety Work Benches/Heraeus Lamin Air HB and HBB" of Heraeus Instruments GmbH. Safety work benches of this type are so constructed that parallel to the work opening a vertically directed air current can be generated which, in the manner of a curtain, prevents the contaminated atmosphere from passing from the working area of the safety work bench to the outside through the work opening. For this purpose, ventilation openings are provided in the basically horizontal boundary plate of the work opening, and through these ventilation openings an air current directed vertically downward is created.

Frequently, it is necessary that manual work be performed for a long period of time at the safety work bench. The person working at the safety work bench is thereby subjected to a relatively high bodily load in the arms. In order to avoid fatigue, especially of the lower arms and hands, the lower boundary plate is hence used as an arm rest for the forearms. For this, the boundary plate can be rounded off on its edge facing outward toward the user. If the boundary plate is used in the manner described as an arm rest, the ventilation openings will be covered by the arms so that a laminar air current is impeded. In this way, the function of this air current is disturbed. Moreover, the boundary plate can only be cleaned at a relatively high cost.

A safety work bench with an arm rest mounted on the lower edge of the work opening is known from GB 2,112,927 A.

SUMMARY OF THE INVENTION

An object of the present invention, proceeding from the known state of the art, is to create a safety work bench in which the arm rests can be easily decontaminated and do not significantly diminish the effective cross section of the ventilation openings.

This object of the invention is accomplished for a safety work bench characterized at the beginning in that the arm rest is constructed as a separate structural member and is detachably mounted on the boundary plate in the ventilation openings and has a resting plate and supports, whereby the supports are secured to the ventilation openings at their lower ends. First of all, a separate arm rest can also be decontaminated separately, and thus very simply, and second, a separate arm rest can be suitably shaped in an ergonomically favorable manner, since it is not subject to the design principle of the boundary plate. Furthermore, having the ventilation openings become closed in an uncontrolled manner by resting the arms on the boundary plate is avoided. With a separate arm rest, the number of closed ventilation openings can be kept to a minimum.

For simple handling it is appropriate that two separate arm rests be provided, so that the arm rest needed for each arm can be arranged individually. It is especially advantageous for the supports to be bent several times in forming two horizontal segments, whereby one horizontal segment lies on the upper side of the boundary plate and the second horizontal segment lies against the underside of the boundary plate.

It is also advantageous for the ventilation openings to be constructed as slots and for several rows of slots to be arranged parallel next to one another in any given case so as to form a grid. Such an arrangement makes possible an almost unlimited variability in arranging the arm rests. A good fixation is guaranteed by the slot-like construction, since the supports can be pushed inside the slots, that is longitudinally within the slots and are thus easy to position. Nonetheless, narrow limits are placed upon movement transverse to the slot, especially when the width of the supports is only slightly smaller than the width of the slots.

BRIEF DESCRIPTION OF THE INVENTION

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIG. 1 is a perspective view of a work opening of a safety work bench with arm rests according to the invention, and FIG. 2 is a side view of one of the arm rests mounted on the boundary plate.

DETAILED DESCRIPTION OF PREFERRED EMBODIMENT

Figure 1:
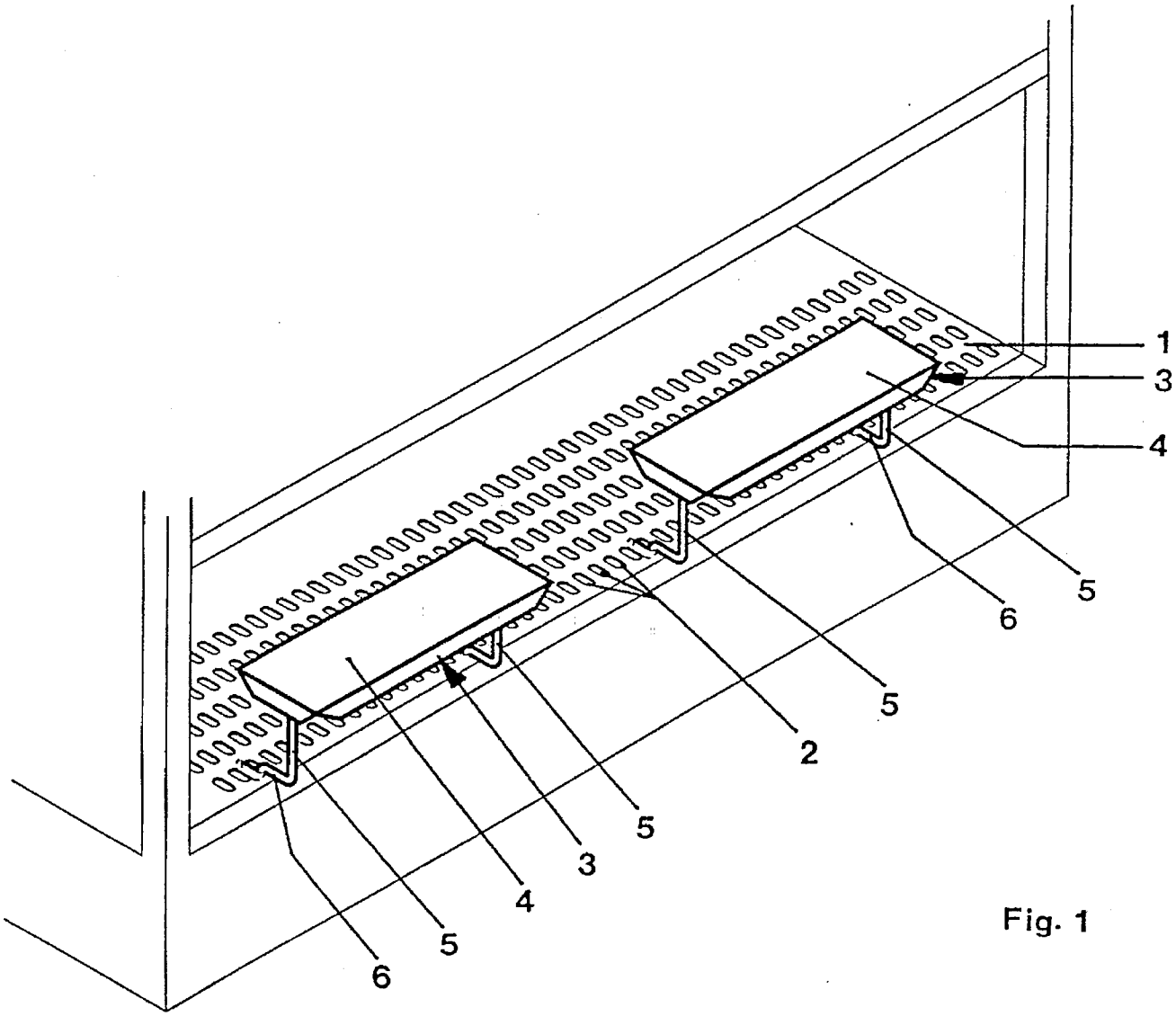

The work opening of the safety work bench is bounded on its lower side by a boundary plate 1. The boundary plate 1 is arranged essentially horizontal and level and has slot-like air openings 2, through which an air current is directed vertically upward. The arm rest 3 has a resting plate 4, which is positioned about 50 mm above the boundary plate 1 and is mounted in the boundary plate 1 with the supports 5.

Figure 2:
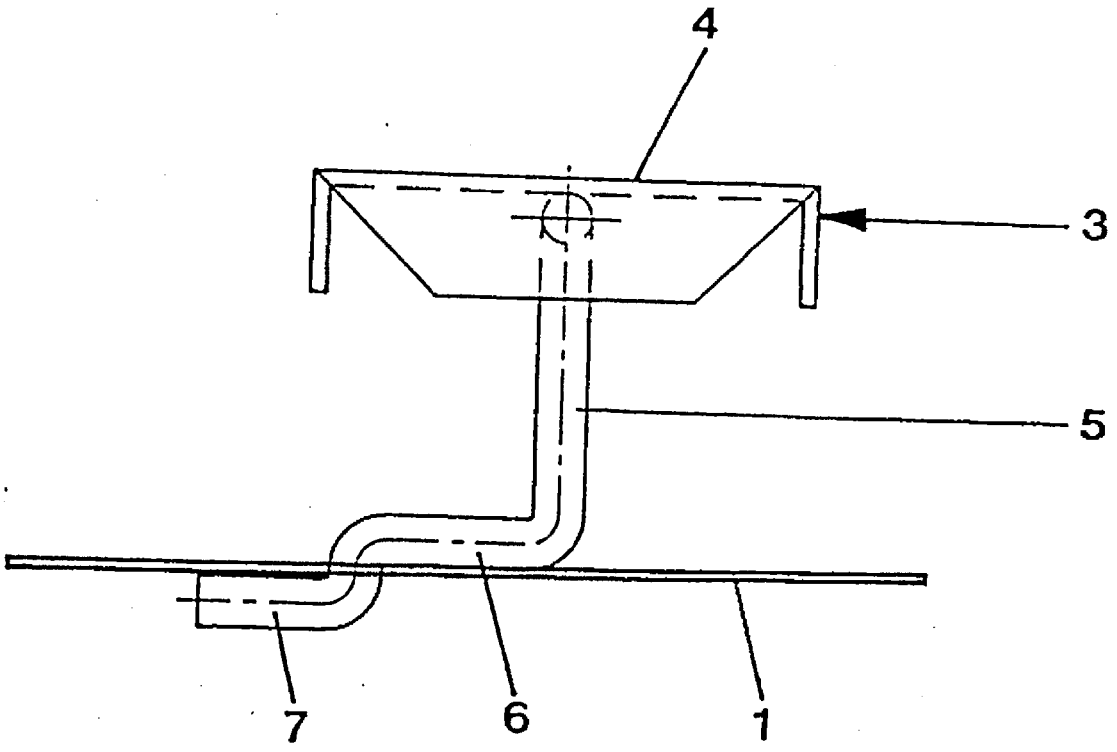

Each support 5 runs downward to the boundary plate 1, and is then bent to a horizontal segment 6 which lies on top of the boundary plate 1. At the end of this first horizontal segment 6, the support 5 is bent downward through one ventilation opening 2, and forms a second horizontal segment 7 beneath the boundary plate 1, which second segment lies against the under side of the boundary plate 1. The two horizontal segments 6, 7 can be arranged stepwise one behind the other, as depicted in FIG. 2, or alternatively as a U-shape. A U-shaped arrangement is, however, less stable. The support 5 can have a transverse segment at its top end (shown only by the circle in FIG. 2) for fixation to the underside of the resting plate 4, such as by welding, brazing, or the like.

The arm rest 3 is made of stainless steel and is thereby easily autoclaved. The supports 5 are constructed of round steel and have a diameter which is only slightly smaller than the width of the slot-like ventilation openings 2, so that the arm rest 3 is also stabilized in a lateral direction. The supports can also be appropriately constructed of flat material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A safety work bench comprising a work opening having as its lower boundary a boundary plate in which ventilation openings are arranged for generating a vertical air current, and at least one arm rest positioned in a lower area of the work opening, the arm rest (3) being constructed as a separate structural member for detachable mounting on the boundary plate (1), the arm rest (3) comprising a support plate (4) and supports (5), the supports (5) at their lower ends being insertable in the ventilation openings (2) for mounting on the boundary plate (1) and holding the arm rest (3) at distance from the boundary plate (1) when mounted.

2. The safety work bench according to claim 1, wherein exactly two separate arm rests (3) are provided.

3. The safety work bench according to claim 1, wherein the supports (5) have several bends therein forming at least two horizontal segments (6, 7), wherein a horizontal segment (6) lies on an upper side of the boundary plate (1) and a second horizontal segment (7) lies against an underside of the boundary plate (1) when the arm rest (3) is in a mounted position.

4. The safety work bench according to claim 2, wherein the supports (5) have several bends therein forming at least two horizontal segments (6, 7), wherein a horizontal segment (6) lies on an upper side of the boundary plate (1) and a second horizontal segment (7) lies against an underside of the boundary plate (1) when the arm rest (3) is in a mounted position.

5. The safety work bench according to claim 1, wherein the ventilation openings (2) are constructed as slots, and several rows of slots are arranged in parallel alongside one another to form a grid.

6. The safety work bench according to claim 2, wherein the ventilation openings (2) are constructed as slots, and several rows of slots are arranged in parallel alongside one another to form a grid.

7. The safety work bench according to claim 3, wherein the ventilation openings (2) are constructed as slots, and several rows of slots are arranged in parallel alongside one another to form a grid.

* * * * *